US010648287B2

(12) United States Patent
Styler et al.

(10) Patent No.: US 10,648,287 B2
(45) Date of Patent: May 12, 2020

(54) ACTUABLE DOWNHOLE TOOLS FOR ATTACHMENT TO TUBULAR STRINGS

(71) Applicant: Dreco Energy Services ULC, Edmonton (CA)

(72) Inventors: Graham S. Styler, Calgary (CA); Lewis R. Facca, Calgary (CA); Andrew N. Sushko, Calgary (CA)

(73) Assignee: DRECO ENERGY SERVICES ULC, Edmonton, Alberta (CA)

( * ) Notice: Subject to any disclaimer, the term of this patent is extended or adjusted under 35 U.S.C. 154(b) by 173 days.

(21) Appl. No.: 15/715,969

(22) Filed: Sep. 26, 2017

(65) Prior Publication Data

US 2019/0093454 A1 Mar. 28, 2019

(51) Int. Cl.
*E21B 34/14* (2006.01)
*E21B 43/08* (2006.01)
(Continued)

(52) U.S. Cl.
CPC ..... *E21B 34/14* (2013.01); *E21B 21/103* (2013.01); *E21B 29/00* (2013.01); *E21B 43/08* (2013.01);
(Continued)

(58) Field of Classification Search
CPC .... E21B 34/14; E21B 43/08; E21B 2034/007; E21B 29/002; E21B 29/00
See application file for complete search history.

(56) References Cited

U.S. PATENT DOCUMENTS 3,071,193 A 1/1963 Raulins
4,880,059 A 11/1989 Brandell
(Continued)

FOREIGN PATENT DOCUMENTS

EP 0427422 A2 5/1991
WO 2017041105 3/2017

OTHER PUBLICATIONS

PCT/CA2018/000178 International Search Report and Written Opinion dated Dec. 21, 2018.
(Continued)

*Primary Examiner* — Blake E Michener
*Assistant Examiner* — Theodore N Yao
(74) *Attorney, Agent, or Firm* — Conley Rose, P.C.

(57) ABSTRACT

A downhole tool, configured to receive a milling tool or other forcing tool, includes: a tubular mandrel; an adapter housing coupled to the mandrel; a guide sleeve disposed within the adapter housing; a movable sleeve configured for sliding movement within the guide sleeve; and a retainer positioned uphole of the movable sleeve. The retainer includes an upper annular portion, a lower annular portion, an annular void between the upper and lower annular portions, and a bridge portion extending between the upper and lower annular portions. The upper annular portion is initially fixed to the guide sleeve. The lower annular portion is configured such that downward movement of the lower annular portion causes the movable sleeve to move downward within the guide sleeve. The bridge portion comprises a through-passage and a thin walled segment adjacent to the void. Milling or otherwise disconnecting the bridge portion permits the lower annular portion to move the moveable sleeve.

19 Claims, 11 Drawing Sheets

(51) Int. Cl.

| | |
|---|---|
| ***E21B 43/267*** | (2006.01) |
| ***E21B 43/28*** | (2006.01) |
| ***E21B 21/10*** | (2006.01) |
| ***E21B 29/00*** | (2006.01) |
| ***E21B 43/26*** | (2006.01) |
| ***E21B 34/00*** | (2006.01) |
| ***E21B 33/122*** | (2006.01) |

(52) U.S. Cl.
CPC ..... *E21B 43/26* (2013.01); *E21B 43/267* (2013.01); *E21B 43/283* (2013.01); *E21B 33/122* (2013.01); *E21B 2034/007* (2013.01)

(56) References Cited

U.S. PATENT DOCUMENTS

| | | | | |
|---|---|---|---|---|
| 8,215,401 | B2 | 7/2012 | Braekke | |
| 8,783,368 | B2 * | 7/2014 | Eriksen | E21B 17/06 166/382 |
| 8,794,331 | B2 | 8/2014 | Getzlaf et al. | |
| 2009/0095471 | A1 * | 4/2009 | Guignard | E21B 34/14 166/278 |
| 2011/0232915 | A1 | 9/2011 | Kellner et al. | |
| 2013/0277053 | A1 * | 10/2013 | Yeh | E21B 33/124 166/278 |
| 2014/0345876 | A1 * | 11/2014 | Coon | E21B 34/14 166/373 |
| 2016/0281466 | A1 | 9/2016 | Richards | |
| 2017/0030168 | A1 * | 2/2017 | Akkerman | E21B 43/12 |
| 2017/0183937 | A1 | 6/2017 | Harper et al. | |
| 2018/0163508 | A1 * | 6/2018 | Kellner | E21B 34/10 |
| 2019/0055810 | A1 * | 2/2019 | Fripp | E21B 33/128 |

OTHER PUBLICATIONS

Aviles, Issac, et al., Degradable Frac ball Holds Solution to Persistent Problem in Fracturing, JPT, Nov. 2013, pp. 32-33 (2 pages).

* cited by examiner

ACTUABLE DOWNHOLE TOOLS FOR ATTACHMENT TO TUBULAR STRINGS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Field of the Disclosure

Embodiments taught herein relate to apparatus, systems, and methods for producing downhole fluids, such as hydrocarbons. More particularly, embodiments taught herein are related to governing the flow of downhole fluids through a sleeve on a tubular string within a wellbore. Still more particularly, embodiments taught herein may be applied to producing through sand screens.

Background to the Disclosure

One problem that is encountered in production after stimulation operations, particularly fracturing, is the large amount of sand or other particulates, including formation fines, produced with the hydrocarbon. Generally, surface equipment is used to separate sand from the produced fluid which adds to the overall cost of production. Downhole screens are known for use in operations such as Steam Assisted gravity Drainage (SAGD) and are generally installed on the outside of the horizontal sections of the production wellbore for production of fluids therealong. Further, screens are installed at the bottom of productions strings in wellbores known to produce large amounts of sand or in inflow control devices (ICD), which address non-uniform production profiles using a series of restrictions or nozzles therealong to maintain a more equal pressure drop from the formation to the wellbore for optimizing production therealong.

In fracturing operations, fracturing fluid including proppant therein is delivered to an earthen formation through tubular strings having pipe sections with multiple radial ports (e.g. perforations, holes). These fracturing ports may be opened before fracturing begins and closed when fracturing is complete. The same or different tubular strings may include screens or other in-flow devices, such as those described above, to produce the fluid from the wellbore. When the tubular string used for fracturing also includes production sections with screens, the production sections are to be closed during fracturing to protect the screen and to insure the fracturing pressure is directed through the fracturing ports. The production sections—already installed downhole—are later opened to initiate production of hydrocarbons into and through the tubular string. Existing production sections that can be opened while downhole include (a) those that use drop balls to slide a sleeve valve, requiring that the drop balls fall downward and dissolve over time or require that the drop ball and ball seat be removed by milling and (b) those that have ports axially aligned with the screen and are opened individually, possibly introducing debris or an obstruction on the inside of the screen. New effective and reliable methods and tools for opening and closing tubular production sections and other tubular sections would be advantageous to the industry.

BRIEF SUMMARY OF THE DISCLOSURE

These and other needs in the art are addressed by the tools and methods described herein.

Disclosed herein is downhole tool for attachment to a tubular string and configured to receive therein a milling tool with a diameter DM. The tool includes: a tubular mandrel configured for attachment to the pipe string; an adapter housing coupled to the mandrel; a guide sleeve disposed within the adapter housing; a movable sleeve disposed within the guide sleeve and configured for sliding movement within the guide sleeve; and a retainer disposed within the guide sleeve at an axial location that is uphole of the movable sleeve. The retainer includes an upper annular portion, a lower annular portion, an annular void between the upper and lower annular portions, and a bridge portion extending between the upper and lower annular portions. The upper annular portion is fixed to the guide sleeve to restrict relative movement of the upper annular portion relative to the guide sleeve, and the lower annular portion is configured such that downward movement of the lower annular portion causes the movable sleeve to move downward within the guide sleeve. The bridge portion comprises a through-passage of diameter D1, wherein the bridge portion defines a thin walled segment of the retainer having an outer diameter D2 that is greater than D1, the thin walled segment being disposed at an axial location adjacent to the void.

In some embodiments, the tool further includes: a screen housing extending axially from the adapter housing and having a first plurality of perforations; and a screen surrounding the screen housing. The movable sleeve extends axially beyond the guide sleeve to a location within the screen housing and includes a second plurality of perforations. The movable sleeve is axially movable with respect to the guide sleeve and the screen housing from a first position in which the first and second plurality of perforations are not aligned to a second position in which the first and second plurality of perforations are aligned to allow fluid flow through the first and second plurality of perforations.

In some embodiments, the tool further includes a perforated housing extending axially from the adapter housing and having a first plurality of perforations. The movable sleeve extends axially beyond the guide sleeve to a location within the perforated housing and includes a second plurality of perforations. The movable sleeve is axially movable with respect to the guide sleeve and the perforated housing from a first position in which the first and second plurality of perforations are not aligned to a second position in which the first and second plurality of perforations are aligned to allow fluid flow through the first and second plurality of perforations.

In some embodiments, the void extends radially from a first end that is adjacent the outer diameter of the thin walled segment to a second end distal the thin walled segment, and wherein the width of the void measured axially is non-uniform. The width of the void is greater at the first end than at the second end in some embodiments, In some embodiments, the diameter D2 is less than DM, and in some embodiments, the upper annular portion has an outer diameter of D3, and wherein D3 is greater than DM.

The bridge portion may comprise a first material and the upper annular portion may comprise a second material wherein, in some embodiments, the first material is different than the second material.

In some embodiments, the lower annular portion of the retainer engages an end of the movable sleeve to move with the movable sleeve, and in some embodiments, the movable sleeve is perforated.

In some embodiments, the upper annular portion of the retainer comprises a beveled surface at its uppermost end, and in some embodiments, the upper annular portion of the retainer may comprise a beveled surface adjacent the void.

Also disclosed herein is a downhole tool for attachment to a tubular string that is configured to receive a forcing tool. The downhole tool includes: a tubular mandrel configured for attachment to the pipe string; a tubular adapter coupled to the mandrel; a movable sleeve coupled to the tubular adapter and including an outer diameter DT; and a retainer. The retainer includes a first annular portion coupled to the tubular adapter so as to restrict the first annular portion from moving relative to the tubular adapter in an axial direction. The retainer also includes a bridge portion coupling the first annular portion to the movable sleeve, the coupling restricting the movable sleeve from moving axially relative to the tubular adapter. The retainer is configured such that decoupling at least a part of the bridge portion from the first annular portion allows the movable sleeve to be moved relative to the tubular adapter in the axial direction.

In some embodiments, the retainer is disposed within the tubular adapter and further includes a second annular portion and an annular void between the first annular portion and the second annular portion. The second annular portion is fixed to the movable sleeve such that downward movement of the second annular portion causes the movable sleeve to move downward. The bridge portion extends between the first annular portion and the second annular portion and includes a through-passage of diameter D1 and a thin walled segment having an outer diameter D2 that is greater than D1 and less than DT, the thin walled segment being disposed at an axial location adjacent to the void. The bridge portion is millable to dislocate part of the bridge portion from the first annular portion to allow the movable sleeve to move relative to the tubular adapter in the axial direction.

In some embodiments, the downhole tool further includes an inward-facing annular recess on an inner surface of the tubular adapter, and a retaining ring disposed radially between the tubular adapter and the movable sleeve. The movable sleeve includes an outward facing annular recess having a first position axially displaced from the inward-facing annular recess and a second position axially aligned with the inward-facing annular recess. The retaining ring is configured such that when the outward facing annular recess is in the second position, the retaining ring is disposed in both the inward-facing annular recess and the outward facing annular recess to restrict the axial movement of the movable sleeve relative to the tubular adapter.

In some embodiments, the tubular adapter includes an adapter housing and a guide sleeve disposed within the adapter housing, the guide sleeve comprising a plurality of slots that extend axially; wherein the movable sleeve is coupled within the guide sleeve. A plurality of guide pins extend radially from the movable sleeve and into the plurality of slots to allow axial movement of the movable sleeve with respect to the guide sleeve and to restrict the rotational movement of the movable sleeve with respect to the guide sleeve.

In some embodiments, the mandrel comprises an inner diameter of D4, and D2 is less than D4.

In some embodiments, the movable sleeve is disposed within the tubular adapter, extends axially away from the tubular mandrel, and extends beyond the tubular adapter.

In some embodiments, the tool further comprises a screen housing extending axially from the tubular adapter and having a first plurality of perforations; and a screen surrounding the screen housing. The movable sleeve is a tubular valve member having a second plurality of perforations, and extending axially from within the tubular adapter to a location within the screen housing, the movable sleeve being axially movable with respect to the tubular adapter and the screen housing from a first position in which the first and second plurality of perforations are not aligned to a second position in which the first and second plurality of perforations are axially aligned.

In some embodiments, the downhole tool further comprises a perforated housing extending axially from the tubular adapter and having a first plurality of perforations; wherein the movable sleeve is a tubular valve member having a second plurality of perforations and extending axially from within the tubular adapter to a location within the perforated housing, the movable sleeve being axially movable with respect to the tubular adapter and the perforated housing from a first position in which the first and second plurality of perforations are not aligned to a second position in which the first and second plurality of perforations are axially aligned.

In some embodiments, the bridge portion comprises a shear pin extending radially from a first end disposed in the first annular portion of the retainer to a second end disposed in the movable sleeve; wherein the shear pin is configured to fracture such that the second end of the shear pin decouples from the first annular portion, allowing the movable sleeve to move relative to the tubular adapter in the axial direction.

In some embodiments, the first annular portion of the retainer is disposed in the recess in the tubular adapter.

Also disclosed is a method for actuating a downhole tool comprising: positioning the downhole tool in a borehole, wherein the downhole tool comprises a housing and a movable sleeve coupled to the housing by a retainer; inserting a forcing tool into the downhole tool; decoupling a first part of the retainer from a second part of the retainer using the forcing tool; and moving the movable sleeve axially relative to the housing by moving the forcing tool axially.

In some embodiments, the movable sleeve is held at a fixed axial position relative to the housing by an annular retainer prior to decoupling the first part of the retainer from the second part of the retainer; wherein decoupling the first part from the second part includes cutting a portion of the annular retainer using a milling tool to allow sleeve to slide relative to the housing.

In some embodiments, the method includes removing the forcing tool from the borehole after moving the movable sleeve; wherein moving the movable sleeve includes pushing against the movable sleeve using the milling tool.

In some embodiments, the movable sleeve is held at a fixed axial position relative to the housing by an annular retainer prior to decoupling the first part of the retainer from the second part; and wherein the forcing tool is a plug; and decoupling the first part of the retainer from the second part includes setting the plug in a portion of the movable sleeve or the annular retainer, and applying a force on the plug to push the plug and the sleeve axially downward relative to the housing.

In some embodiments, the movable sleeve is coupled to the housing by at least one shear pin; and wherein decoupling a first part of the retainer from a second part includes pushing the movable sleeve using the forcing tool and severing the shear pin.

In some embodiments, the housing includes a first plurality of perforations, and the movable sleeve is a tubular valve member axially movable with respect to the housing and having second plurality of perforations. Moving the movable sleeve includes sliding the movable sleeve from a first position in which the first and second plurality of perforations are not arranged for fluid communication to a second position in which the first and second plurality of perforations are arranged for fluid communication therethrough.

Thus, embodiments described herein include a combination of features and characteristics intended to address various shortcomings associated with certain prior devices, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
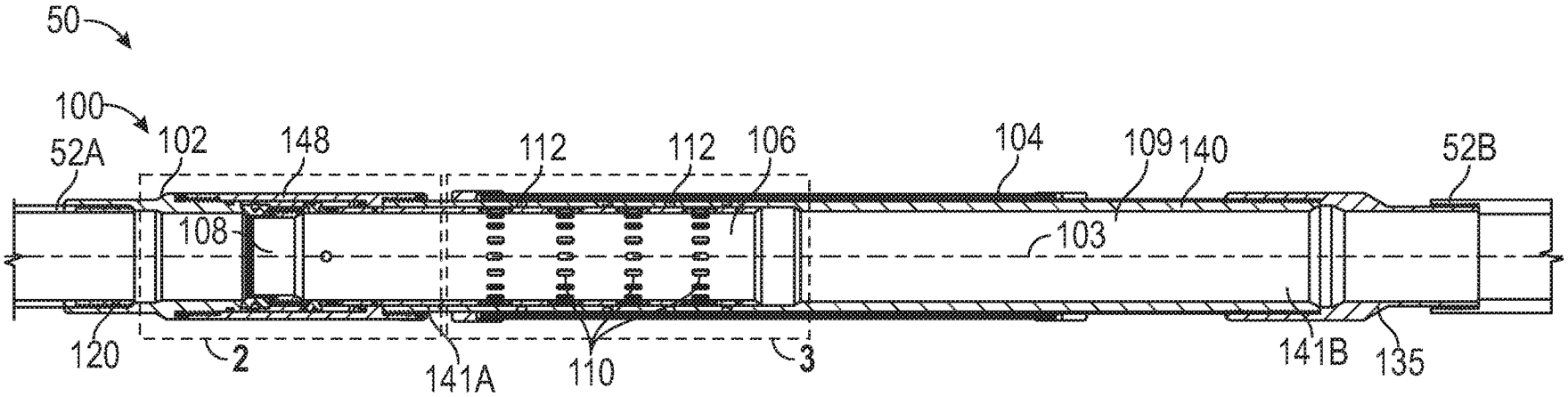
FIG. 1 shows a side view in cross-section of an embodiment of a tubular string having a completion tool for downhole use, in a closed configuration, in accordance with principles described herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B." In addition, the word "substantially" means within a range of plus or minus 10%.

In addition, the terms "axial" and "axially" generally mean along or parallel to a given axis, while the terms "radial" and "radially" generally mean perpendicular to the axis. For instance, an axial distance refers to a distance measured along or parallel to a given axis, and a radial distance means a distance measured perpendicular to the axis. Furthermore, any reference to a relative direction or relative position is made for purpose of clarity, with examples including "top," "bottom," "up," "upper," "upward," "down," "lower," "clockwise," "left," "leftward," "right," and "right-hand." For example, a relative direction or a relative position of an object or feature may pertain to the orientation as shown in a figure or as described. If the object or feature were viewed from another orientation or were implemented in another orientation, it may then be helpful to describe the direction or position using an alternate term. In regard to a borehole, "up," "upper," "upward," "upstream," "uphole," and similar terms mean toward the point of entry of the borehole at the surface of the earth, and "down," "lower," "downward," "downstream," "downhole," and similar terms means toward the terminal end of the borehole, regardless of the borehole's physical orientation or path. The term groove will refer to an elongate recess. Thus, a groove is an example of a recess.

DETAILED DESCRIPTION OF THE DISCLOSED EXEMPLARY EMBODIMENTS

Embodiments herein disclose actuable downhole tools for attachment to tubular strings. The actuable tool includes a tool member that is axially movable relative to the tubular string. In an example described more fully below, an actuable downhole tool includes a valved pipe segment having radially-extending ports and having an annular valve member configured to move axially relative to the ports so as to open or close the ports, either allowing or restricting the entry of wellbore fluid into the pipe segment. In one example, the valved pipe segment may be closed and installed before fracturing is performed, and may be opened after fracturing is completed in order to produce the well. The valved pipe segment may be subsequently re-closed for a later fracturing operation or for another purpose.

Figure 2:
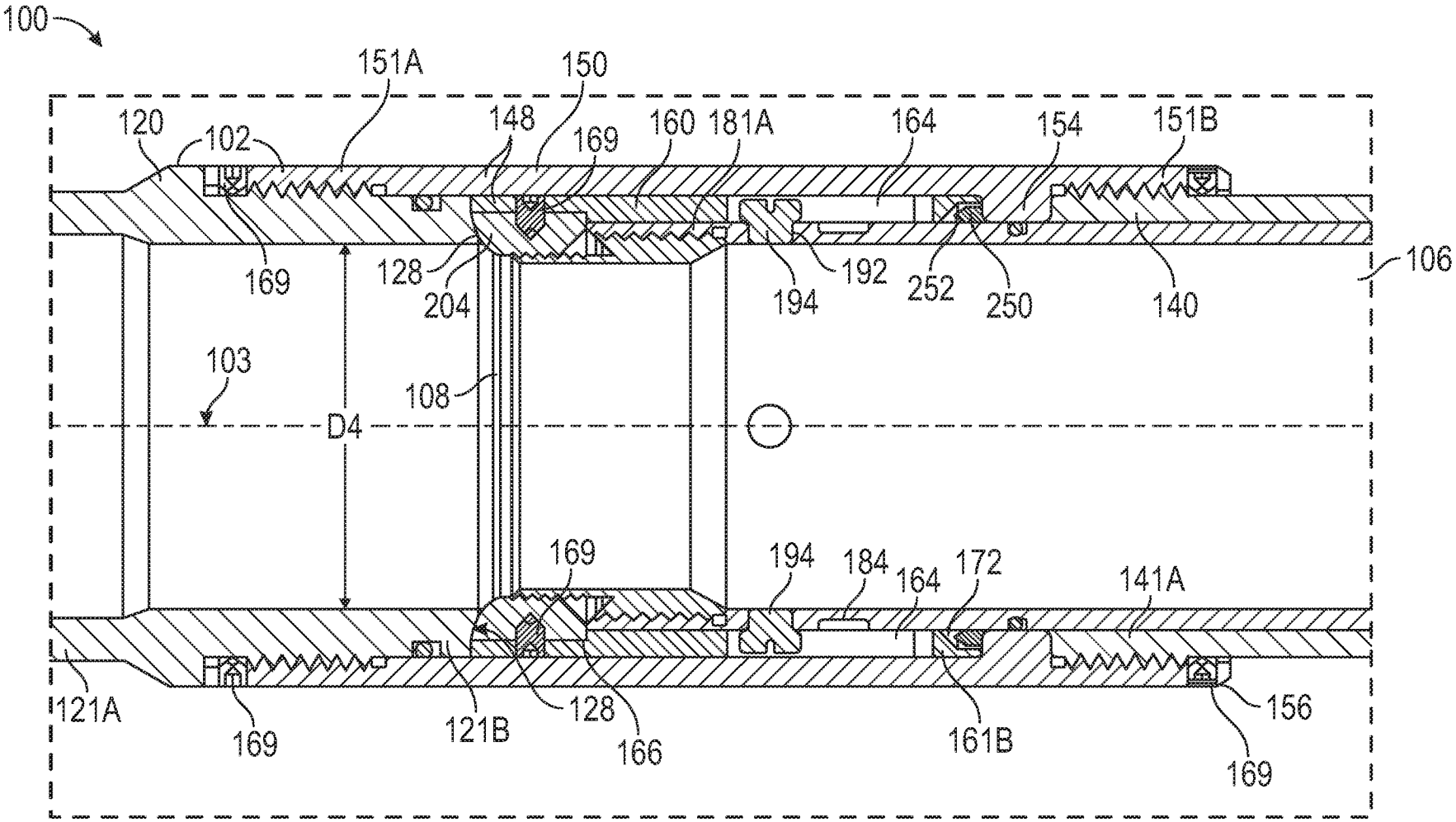
FIG. 2 shows a close view near the upper end of the completion tool of FIG. 1.
Figure 3:
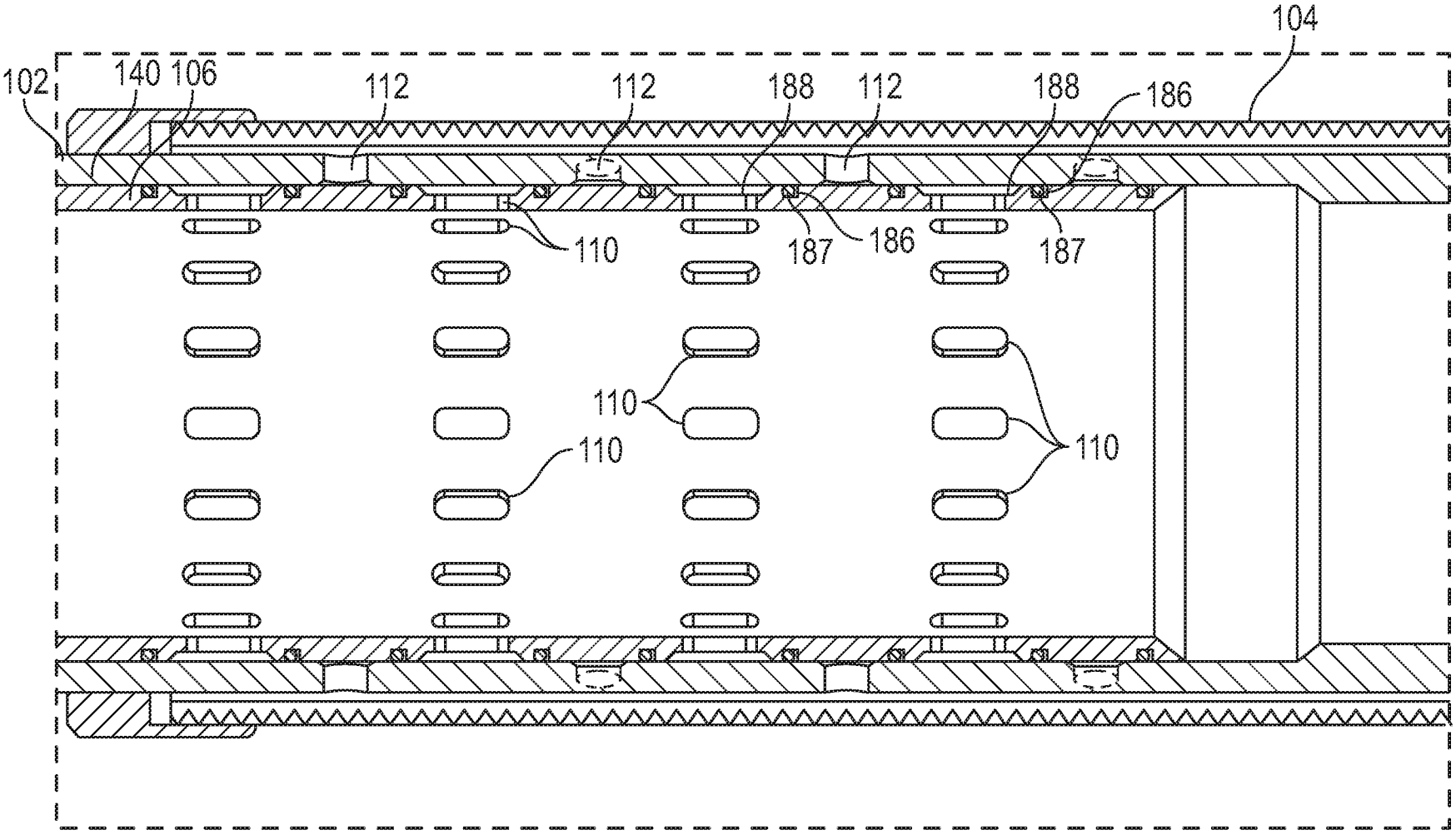
FIG. 3 shows a close view of the completion tool of FIG. 1 at a position lower than the view of FIG. 2.

Referring to FIG. 1, in an exemplary embodiment, a pipe string, which is a completion string 50, includes an actuable downhole tool, which in this example is a completion tool 100, coupled between upper and lower tubular members 52. Other tools or "subs" can be incorporated into completion string 50 above or below tool 50. Tool 100, which is screened sleeve assembly in this example, includes a tubular housing 102 extending along an axis 103, a screen 104 surrounding the housing, a movable sleeve 106 disposed within the housing and held in place by a millable annular retainer 108. In this example, sleeve 106 is perforated and may also be called perforated sleeve 106. The term "perforated" will be used to mean that an object includes a plurality of holes, apertures, slots, or the like, allowing fluid to flow through a wall of the object. A bore 109 extends through tool 100 along axis 103. During operation, retainer 108 may be partially removed by a milling tool to allow the sleeve 106 to slide within housing 102 so that a plurality of circumferentially and axially-spaced apertures or ports 110 in sleeve 106 may align with a plurality of circumferentially and axially-spaced apertures or ports 112 in housing 102 that are axially aligned with screen 104. When ports 110 are aligned with ports 112, fluid communication is possible between inner bore 109 and the outer surface of tool 100 through screen 104, which would, for example, allow hydrocarbons to flow into tool 100 depending on the pressure differential. FIG. 2 and FIG. 3 provide closer (enlarged) views of portions of tool 100, as indicated in FIG. 1.

String 50 and tool 100 may be installed for operation in a borehole that may serve as a wellbore and may pass through a hydrocarbon bearing zone. In FIG. 1, the left direction on axis 103 is directed uphole, and the right direction on axis 103 is directed downhole. In some instances, tool 100 may be located in a substantially horizontal portion of the wellbore while in other instances tool 100 may be located a substantially vertical portion of a well bore. Tool 100 may be used in screen subs, packers, valves, inflow control devices (ICD's), and steam-assisted gravity drainage (SAGD) operations as examples. Some additional equipment that may be used in completion string 50 is described in international patent application PCT/US16/50426, filed Sep. 6, 2016 and incorporated herein by reference for all purposes.

Continuing to reference FIG. 1, housing 102 includes an upper tubular mandrel 120, a lower tubular mandrel 135 spaced-apart from mandrel 120 along axis 103, a perforated housing 140 threadingly coupled to mandrel 135 and extending toward mandrel 120, and a tubular adapter 148 threadingly coupled to mandrel 120 and housing 140. Upper and lower tubular mandrels 120, 135 are coupled to upper and lower tubular members 52, respectively, of completion string 50. Screen 104 is disposed about and coupled to perforated housing 140, which may also be called a screen housing 140 in this embodiment.

Figure 4:
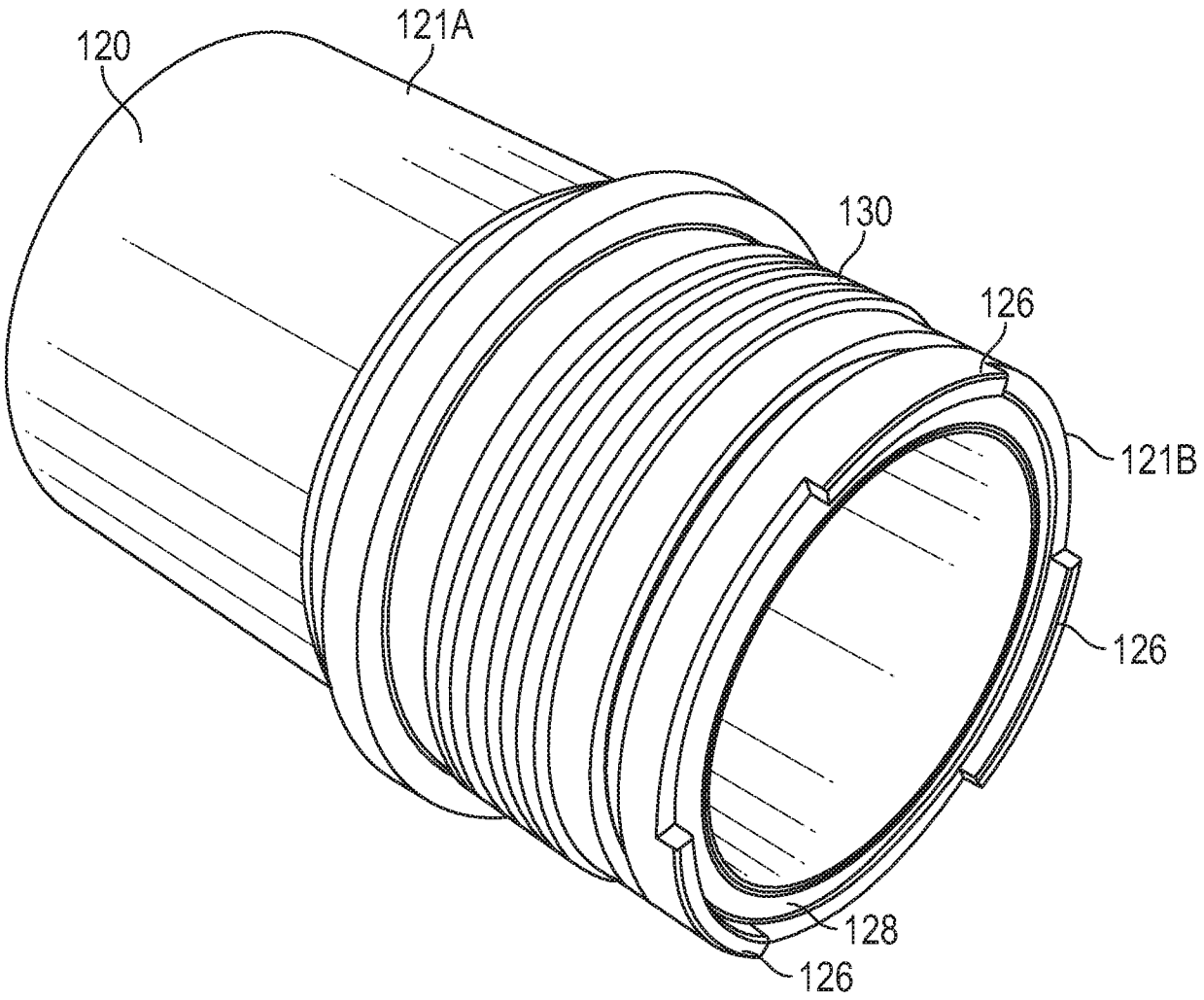
FIG. 4 shows a perspective view of a tubular mandrel of the completion tool of FIG. 1.

Referring now to FIG. 2 and FIG. 4, upper tubular mandrel 120 includes a threaded upper box end 121A configured to couple the upper tubular member 52 and a lower end 121B having a plurality of circumferentially-spaced slots 126 and an annular, externally-facing beveled surface 128, located radially inside the slots 126. Slots 126 make lower end 121B castellated. Upper mandrel 120 further includes external threads 130 between ends 121A, 121B to couple to adapter 148 so that adapter 148 surrounds the slots 126 and beveled surface 128 when coupled to threads 130. Upper mandrel 120 has an inner diameter D4.

Referring to FIGS. 1 to 3, housing 140 extends from an upper end 141A to a lower end 141B and includes the ports 112, proximal end 141A. Lower end 141B threadingly couples within an upper end of mandrel 135.

Figure 5:
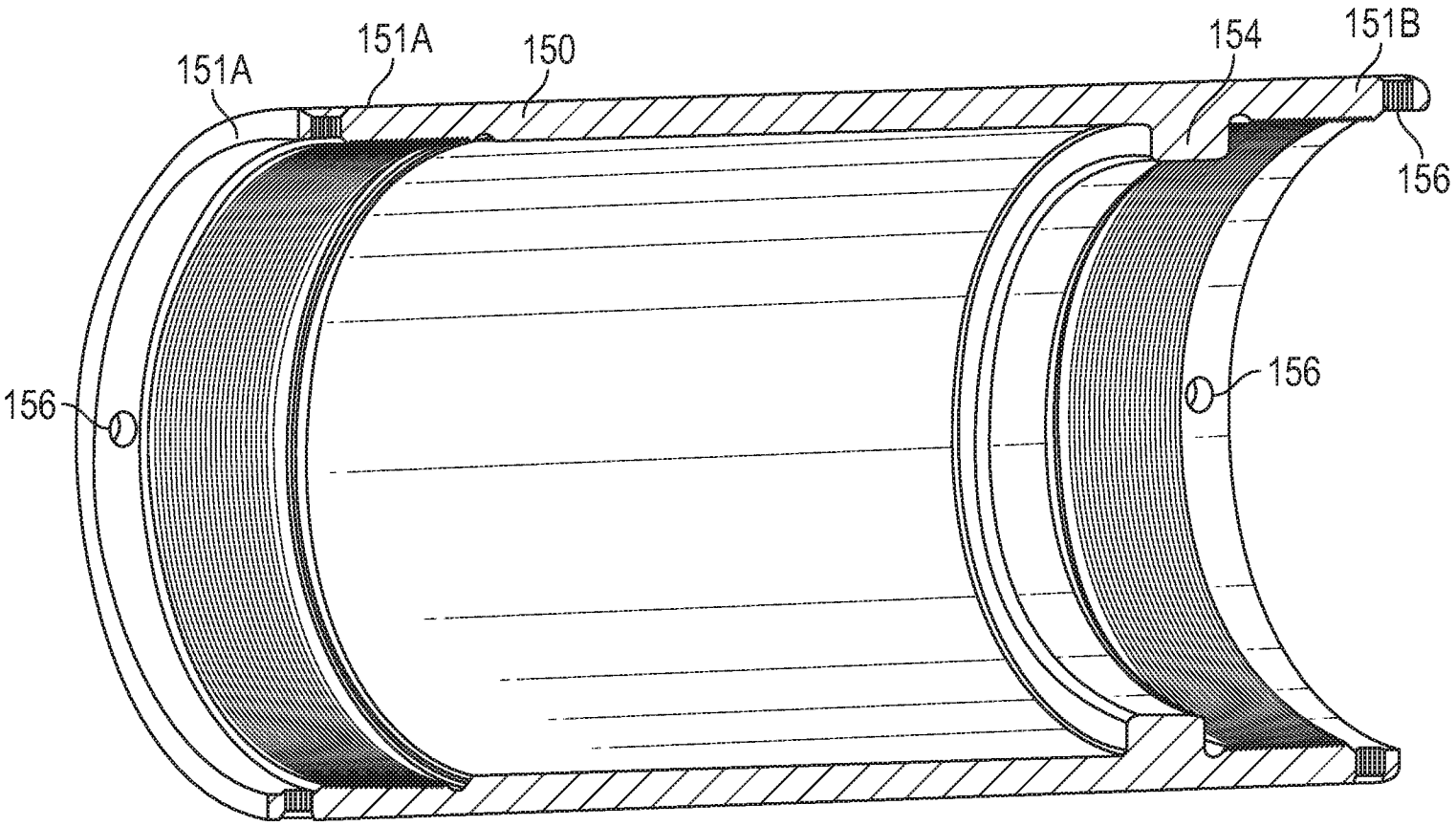
FIG. 5 shows a perspective view in cross-section of the adapter housing of the completion tool of FIG. 1.

Referring to FIG. 2, tubular adapter 148 includes an adapter housing 150 and a guide sleeve 160 located inside housing 150. Sleeve 160 resists rotation of perforated sleeve 106, and so guide sleeve 160 may also be called a torque sleeve. Shown in FIG. 2 and FIG. 5, adapter housing 150 includes an internally-threaded upper end 151A, an internally-threaded lower end 151B, an annular, inward protrusion 154 adjacent lower end 151B, and a plurality of radially-extending threaded holes 156 at each end 151A, 151B to receive set-screws.

Figure 6:
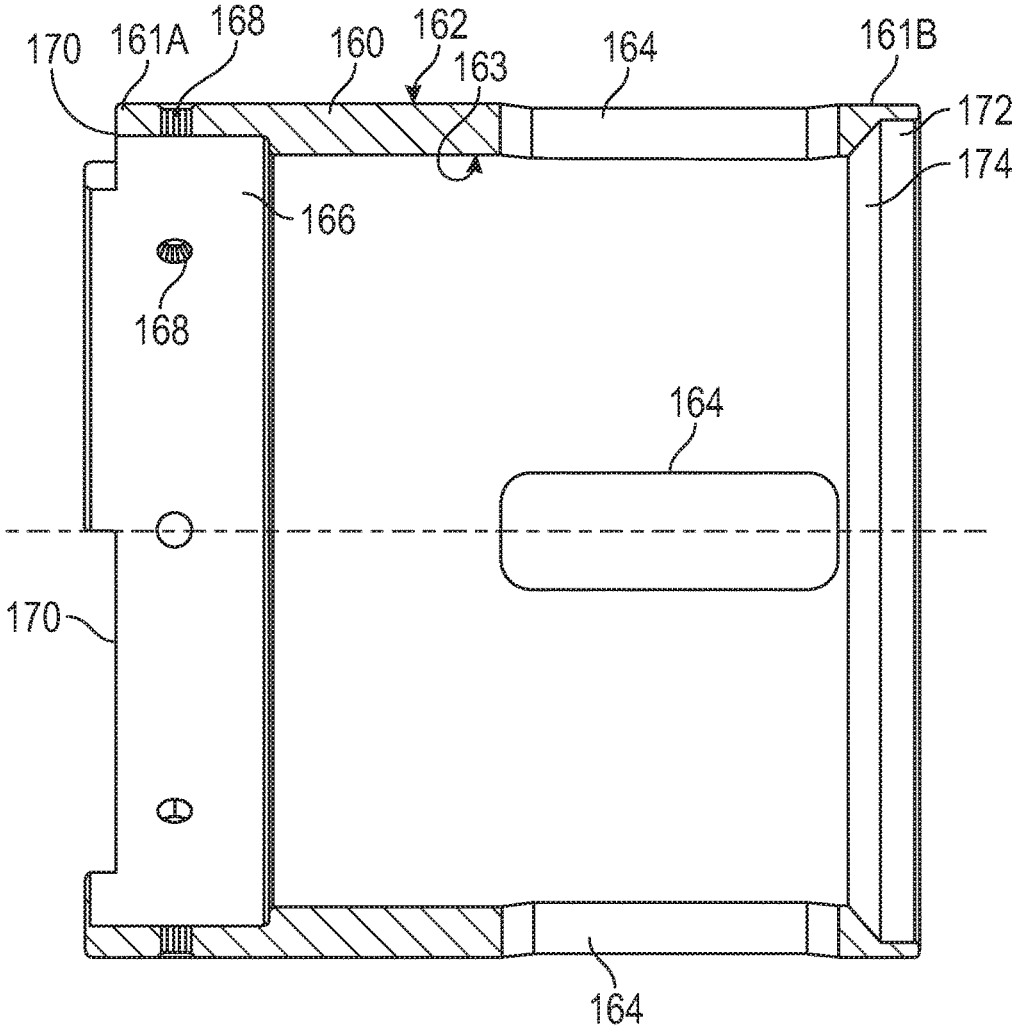
FIG. 6 shows a side view in cross-section of the guide sleeve of the completion tool of FIG. 1.

Shown in FIG. 2 and FIG. 6, guide sleeve 160 includes an upper end 161A, a lower end 161B, an outer surface 162, an inner surface 163, a plurality of circumferentially-spaced, axially-extending, elongate slots 164 proximal lower end 161B, and an inward-facing annular recess 166 at upper end 161A. Slots 164 extend radially through inner surface 163 and outer surface 162. Upper end 161A also includes a plurality of radially-extending holes 168 extending through recess 166, each hole 168 is to receive set-screws 169 to hold retainer 108 in-place, and end 161A is castellated by a plurality of slots 170. An annular recess 172 extends axially inward from lower end 161B and includes a beveled surface 174 that intersects inner surface 163. Beveled surface 174 faces axially downward and radially inward. As shown in FIG. 2, guide sleeve 160 is received within housing 150, having lower end 161B butted against an upper shoulder or protrusion 154. Recess 172 is likewise adjacent protrusion 154, forming an inward-facing annular groove on the inner surface of tubular adapter 148.

Figure 7:
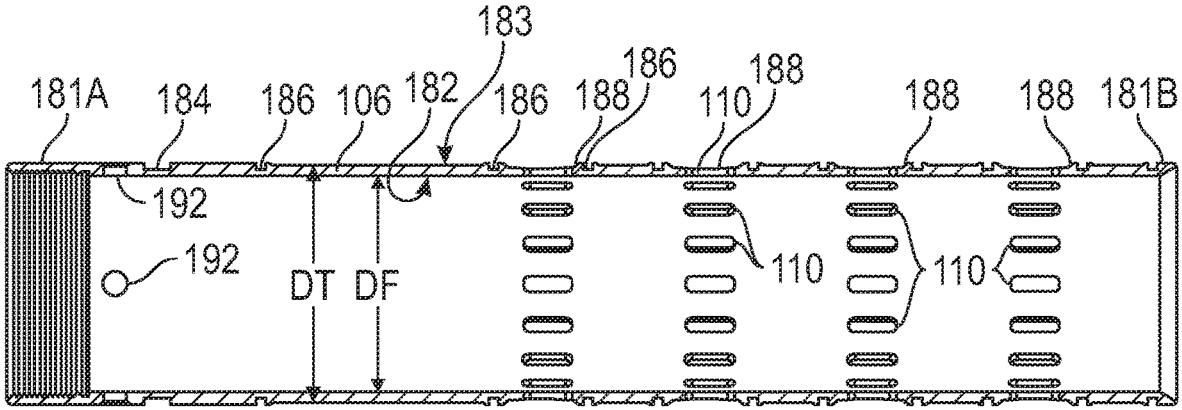
FIG. 7 shows a side view in cross-section of the movable perforated sleeve of the completion tool of FIG. 1.

Referring now to FIG. 7, perforated sleeve 106 extends axially from an inward beveled and internally-threaded upper end 181A to an inward beveled lower end 181B. Perforated sleeve 106 includes an inner surface 182 and an outer surface 183 having an outer diameter DT, and axially-space groups of the ports 110 extending through surfaces 182, 183. Each group includes a plurality of the ports 110. Outer surface 183 includes an annular groove 184 proximal upper end 181A, a plurality of annular grooves 186 to receive sealing members 187 (FIG. 3), and a plurality of axially-spaced, annular recesses 188. Each recess 188 is axially aligned with and intersects a group of circumferentially-spaced ports 110 and is disposed between a pair of grooves 186. In FIG. 7, sleeve 106 includes four recesses 188. Sleeve 106 further includes a plurality of circumferentially-spaced holes 192 located between upper end 181A and groove 184. As best shown in FIG. 2, a guide pin 194 is threaded into each hole 192 and extends radially-outward into a slot 164 of guide sleeve 160 to couple sleeve 106 for sliding movement within adapter 148. This example includes four sets that include a slot 164, a hole 192, and a pin 194. Each guide pin 194 allows axial movement of sleeve 106 with respect to the guide sleeve 160 and restricts the rotational movement of sleeve 106 with respect to the sleeve 160. Given this configuration, sleeve 106 is an example of a tool member that is slidably coupled to a tubular housing or adapter for operation downhole. Even so, sliding movement of sleeve 106 relative to sleeve 160 is restricted while the annular retainer 108 is intact.

Figure 8:
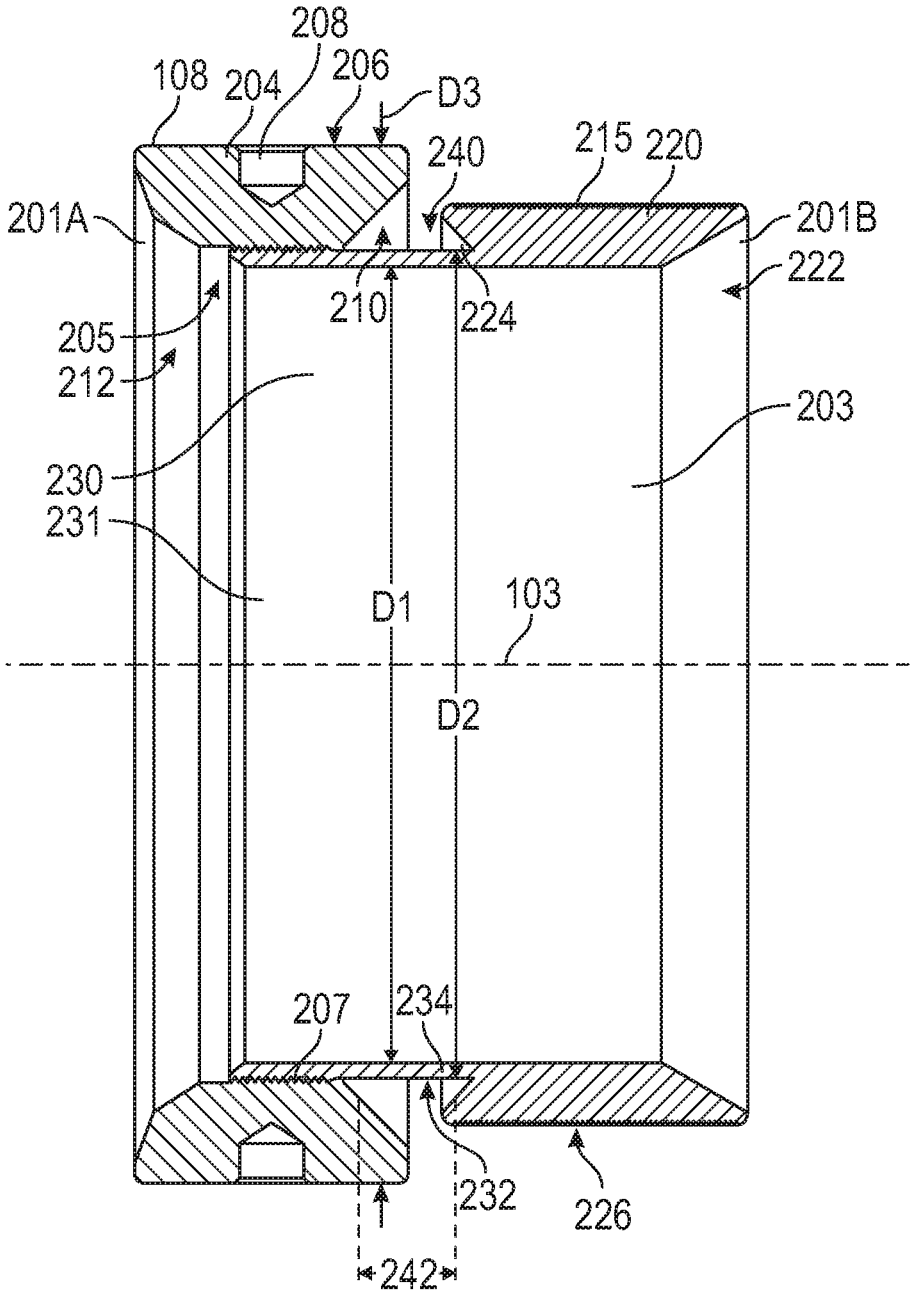
FIG. 8 shows a side view in cross-section of the annular retainer of the completion tool of FIG. 1.

Referring now to FIG. 8, annular retainer 108 is shown to extend along an axis 103 from an upper end 201A to a lower end 201B with a through-passage 203 having an inner diameter D1 extending therethrough. Annular retainer 108 includes a retainer member 204 coupled to a retainer member 215 by mating threads 207 in this embodiment. Retainer member 204 will also be called upper annular portion 204 and includes upper end 201A, a threaded inner surface 205, an outer surface 206 having an outer diameter D3, threaded holes 208 extending through surface 206, and a beveled surface 210 opposite end 201A. The end 201A intersects inner surface 205 at a beveled surface 212 that faces axially upward and radially inward. Retainer member 215 includes an externally-threaded lower annular portion 220 and a bridge portion 230 that extends opposite lower end 201B. Through-passage 203 forms the inner surface of lower annular portion 220 and bridge portion 230. Lower annular portion 220 extends from lower end 201B having a beveled surface 222 to a beveled surface 224 at its upper end. Beveled surface 222 faces axially downward and radially inward. Beveled surface 224 faces axially upward and radially inward. Lower annular portion 220 has a threaded outer surface 226. In some embodiments, the upper annular portion 204 and retainer member 215 are made from the same material, and in some embodiments, portion 204 and member 215 are made from different materials. As examples, portion 204 or retainer member 215 may be made from cast iron, steel, aluminum, a composite material, a dissolvable material, or some other material that has sufficient strength to at least temporarily hold portion 204 and retainer member 205 together until it is desired to open tool 100 by moving the sleeve 106. In some embodiments, portion 204 and member 215 are each made of cast iron, or each made of steel, as examples. In some embodiments, retainer member 215, including bridge portion 230, is made from a material that is different than the material of upper annular portion 204, including any of the materials already discussed. For example, in some embodiments, retainer member 215, including bridge portion 230, is made of case iron, while upper annular portion 204 is made of steel or vice versa.

Bridge portion 230 includes a thin walled segment 234 that intersects beveled surface 224 and extends to an externally threaded upper end 231, which includes a beveled surface that faces axially upward (to the left in FIG. 8) and radially inward. Bridge portion 230 joins upper annular portion 204 and lower annular portion 220 and has an outer surface 232 of diameter D2. As shown in FIG. 7 and FIG. 8, outer diameter D2 of thin walled segment 234 is less than the outer diameter DT of sleeve 106. Referring again to FIG. 8, upper annular portion 204 is coupled to retainer member 215 by the engaged pair of threads on inner surface 205 and upper end 231. Thin walled segment 234 is defined by inner diameter D1 and the larger, outer diameter D2. The intersection of beveled surfaces 210, 224 and the outer surface 232 of bridge portion 230 form an annular void or groove 240 therebetween, and bridge portion 230 spans the groove 240. Groove 240 has a width 242 measured along axis 103 that decreases as groove 240 extends radially outward from surface 232. Thus, in the axial direction, width 242 of groove 240 is thus non-uniform. For example, in axial cross-section of FIG. 8, groove 240 is generally triangular or trapezoidal, having a shape similar to a dovetail groove, being smaller distal the outer surface 232. In some other embodiments, a void, groove, notch, etc. having another shape may be used for groove 240.

Referring again to the assembly of FIG. 1 and FIG. 2, upper end 151A of adapter housing 150 is threadingly coupled to upper mandrel 120. Lower end 151B of adapter housing 150 is threadingly coupled to screen housing 140, which butts against the lower shoulder of protrusion 154. A plurality of set-screws 169 are installed in holes 156 at each end 151A, 151B to restrict or prevent rotation of housing 150 relative to mandrel 120 and screen housing 140; thus the threads therebetween may be straight, non-tapered threads. Guide sleeve 160 is held between mandrel 120 and the upper shoulder of protrusion 154. At upper end 161A of sleeve 160, slots 170 (FIG. 6) engage with slots 126 (FIG. 4) of mandrel 120 to restrict sleeve 160 from rotating relative to relative to mandrel 120 and housing 150.

Upper portion 204 of retainer 108 is located in recess 166 of guide sleeve 160 and is held axially against lower surface 128 of mandrel 120. Portion 204 is held against rotation by set-screws 169 extending from sleeve 160. Movement of the upper annular portion 204 relative to guide sleeve 160 is thereby restricted. Retainer member 215 of retainer 108 is threadingly coupled to upper end 181A of perforated sleeve 106, holding sleeve 106 in a fixed axial position while retainer member 215 is coupled to upper portion 204. With this configuration, bridge portion 230 couples the annular upper portion 204 to sleeve 106 to restrict the sleeve 106 from moving relative to the tubular adapter 148 along axis 103. Guide pins 194 extending from sleeve 106 into slots 164 of guide sleeve 160 restrict sleeve 160 from rotating relative to housing 102. In FIG. 2, sleeve 106 and its outward-facing groove 184 are in a first position, in which groove 184 is spaced axially upward (to the left) from inward-facing annular groove or recess 172 in guide sleeve 160. A lock ring 250 having upward facing beveled surfaces 252 is located in recess 172 adjacent protrusion 154 and surrounds perforated sleeve 106, axially spaced from groove 184. Referring now to FIG. 1 and FIG. 3, tool 100 is closed because ports 110 in sleeve 106 are not aligned with ports 112 in housing 102 and are isolated from ports 112 by sealing members 187. This is a closed position of sleeve 106 with respect to housing 102 and its screen housing 140. Ports 110 are spaced axially upward from the corresponding ports 112 with which they may align.

Figure 9:
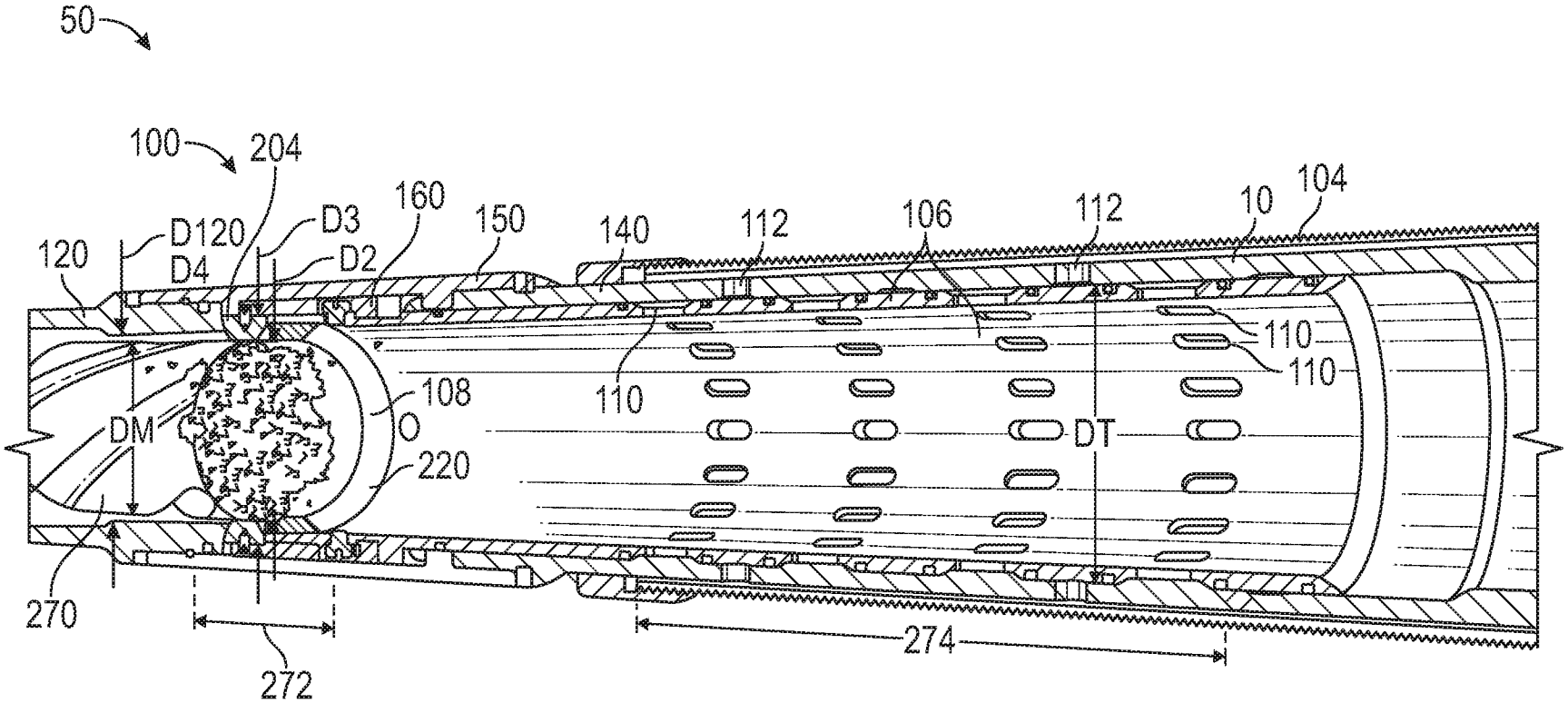
FIG. 9 shows a perspective view, partially in cross-section, of the completion tool of FIG. 1 while a milling tool is cutting through a radially-inner portion of the retainer of FIG. 8.

To describe the operation of completion tool 100, a situation will be considered in which a milling tool has traveled downhole through completion string 50 and has reached completion tool 100. Referring now to FIG. 9, a milling tool 270 is received within tool 100 traveling and rotating to cut-through the radially-inner material of retainer 108 and remove part or all of bridge portion 230. Tool 270 may also remove some of retainer upper portion 204 and/or lower annular portion 220 of retainer member 215. Tool 270 has a maximum cutting diameter DM that is that is greater than the outer diameter D2 of bridge portion 230 so that the cutting process of tool 270 will disconnect retainer member 215 from the upper annular portion 204 of retainer 108. Alternatively, in some embodiments, the maximum cutting diameter DM of tool 270 is less than the outer diameter D2. Even so, lateral movement of tool 270, which may be due to vibration for example, may cause tool 270 to cut or weaken bridge portion 230 and allow the separation of the upper and lower annular portions 204, 220.

Figure 10:
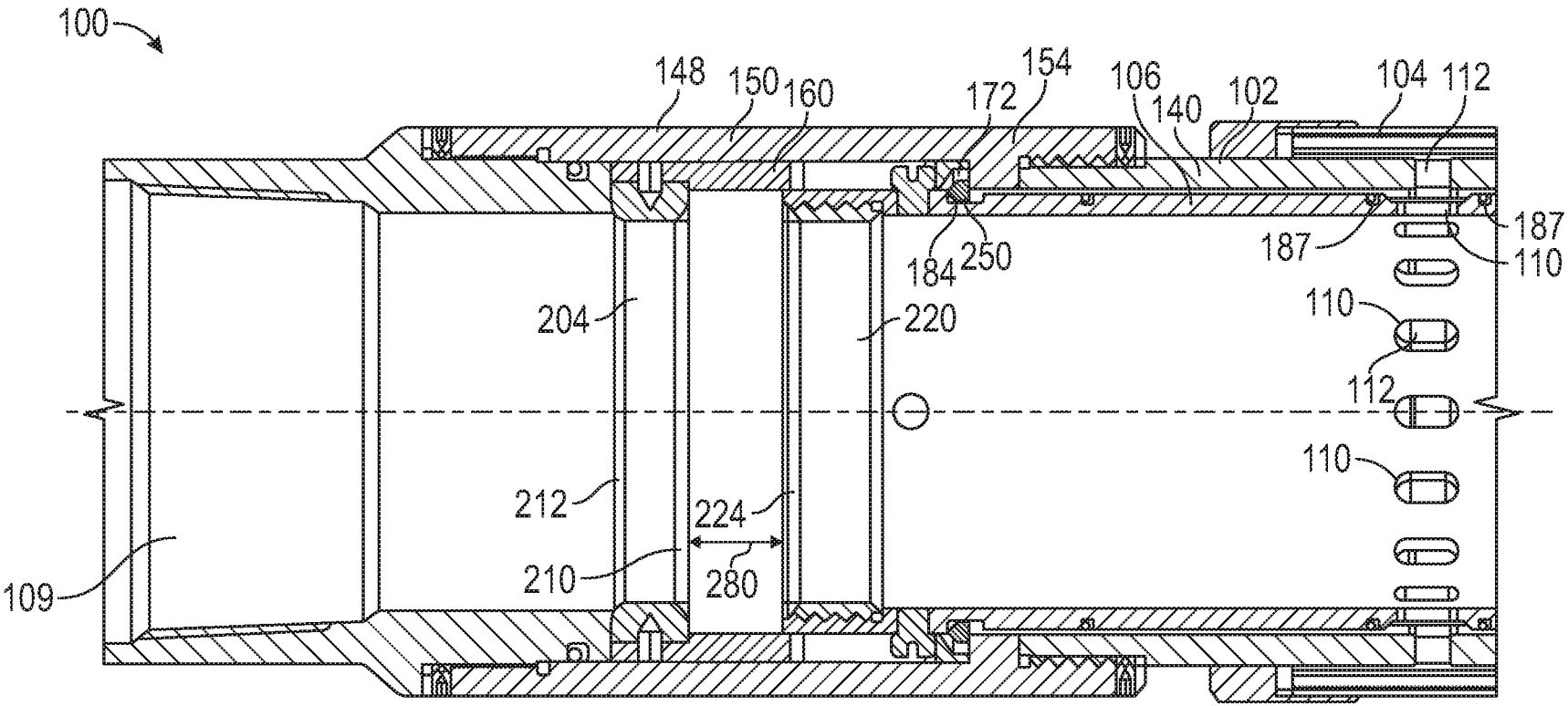
FIG. 10 shows a side view in cross-section of the upper end of the completion tool of FIG. 1, in an open configuration after completion of the milling operation of FIG. 9.

The inner diameter D4 of upper of mandrel 120 may be greater than outer diameter D2 and greater than DM to allow tool 270 to reach and cut bridge portion 230 without cutting the inner surface of mandrel 120. Diameter D3 of upper portion 204 is greater than DM, so that some of portion 204, including parts of beveled surfaces 210, 212, will remain after the milling is completed. Milling tool diameter DM is less that the inner diameters of mandrel 120 and perforated sleeve 106. As described, retainer 108 is configured such that decoupling at least a part of the bridge portion 230 (e.g. the milled-away portion) from the upper annular portion 204 and adapter 148 allows perforated sleeve 106 to slide downward (to the right in FIG. 9) relative to the tubular adapter 148 along axis 103. During cutting, tool 270 pushes downward on retainer member 215. Tool 270 eventually separates lower annular portion 220 from upper annular portion 204 and moves the lower annular portion 220 and the perforated sleeve 106 downward with respect to housing 102, as shown in FIG. 10. Thus, lower annular portion 220 is configured such that downward movement of lower annular portion 220 causes perforated sleeve 106 to move downward within the guide sleeve 160. In some instances, milling may continue after lower annular portion 220 and perforated sleeve 106 move through a separation distance 280, which may be limited by sleeve 106 pressing against a shoulder at the lower end of screen housing 140 or lower tubular mandrel 135 (FIG. 1).

Referring again to the example of FIG. 9, the axial length 272 of retainer 108 that is to be milled is shorter than the axial length 274 of the flow zone that includes all the ports 110 or all the ports 112. The flow zone of screen 104 may be longer. As examples, the axial length of the flow zone may be 2, 4, 5, or 10 times longer or more than the axial length of retainer 108. Thus, milling a short distance or area opens a longer and larger flow area for hydrocarbons. In addition, the milling occurs at a location that is axially separated from ports 110 so that the resulting chips and fragments of retainer 108 are less likely to enter or to be pushed into ports 110, 112 or screen 104, which might choke or clog. This potential for clogging may be further reduced because the milling location, the location of retainer 108, is upstream of the ports 110, 112. So, as milling tool 270 finishes cutting and pushes sleeve 106 to an open position, a fluid from an earthen zone adjacent screen 104 may begin to enter and flow up (to the left in FIG. 9) within tool 100, pushing the some or all cuttings of retainer 108 further away from ports 110, 112 before tool 270 has the opportunity to pass by ports 110, 112. The inner diameter DF of the flow region, which is an inner diameter of sleeve 106, may be equal to or greater than the diameter DM of tool 270. Thus, diameter DF is independent of diameter DM.

In FIG. 10, perforated sleeve 106 of tool 100 is shown in an open position with respect to housing 102. Sleeve 106 and lower annular portion 220 of retainer 108 are displaced axially from upper portion 204 and mandrel 120, resulting in a separation distance 280 as measured from portion 204. As a result of the milling, the diameter of bore 109 of tool 100 in the vicinity of retainer 108 has been enlarged. The diameter of bore 109 in other places within tool 109 may be unaffected. Ports 110 in sleeve 106 are aligned with ports 112 in housing 102, providing fluid communication through the ports 110, 112 and between the inner bore 109 and the outer surface of tool 100, including screen 104 to allow hydrocarbons or another fluid to flow into or out from tool 100. Guide pins 194 have slid toward the downward ends of slots 164 in guide sleeve 160. Sleeve 106 and its groove 184 have moved axially to a second position, a position in which groove 184 is axially aligned with recess 172. Groove 184 has received lock ring 250, which is now lodged within both groove 184 and recess 172 adjacent the protrusion 154 of tubular adapter 148.

The residual part of a beveled surface 210, 212, 224 may provide a passageway through the bore 109 that is easy for other equipment, such as a dissolvable ball of a selected range of diameters, to pass through. In some instances, a beveled surface 210, 212, 224 may act as a seat to capture an object, such as a dissolvable ball. Examples of using dissolvable objects in a completion string are discussed in the international patent application PCT/US16/50426, which has been incorporated herein by reference.

A movable sleeve 106 of the above-described embodiments may be configured so as to be moved from an open position (e.g. FIG. 10) to a closed position (e.g. FIG. 1) by using a shifting tool (not shown). In some embodiments, sleeve 106 may be moved from a closed position to an open position by using a shifting tool, at least after a milling process has been completed. A shifting tool has a plurality of circumferentially positioned "dogs" or collets that may expand outward, against and grasp the inner surface of sleeve 106. In some instances, the shifting tool may latch into a profile located in the inner surface of sleeve 106. The shifting tool may be delivered or lifted by coiled tubing or a pipe string extending from the surface to slide sleeve 106 upward so that ports 110, 112 are no longer aligned and are, instead, isolated from each other by sealing members 187. Lock ring 250 resists removal from groove 184, such as may be imparted by a shifting tool. In some embodiments, lock ring 250 may be described as a detent lock ring. In some embodiments, lock ring 250, groove 172, or groove 184 is configured to allow lock ring 250 to "pop-out" from groove 184 and to slide along the outer surface of sleeve 106 so that lock ring 250 is removable. Later, the sleeve 106 could be again pushed downward to the open position so that tool 100 may be opened and closed repeatedly to accommodate various well operations or conditions.

Figure 11:
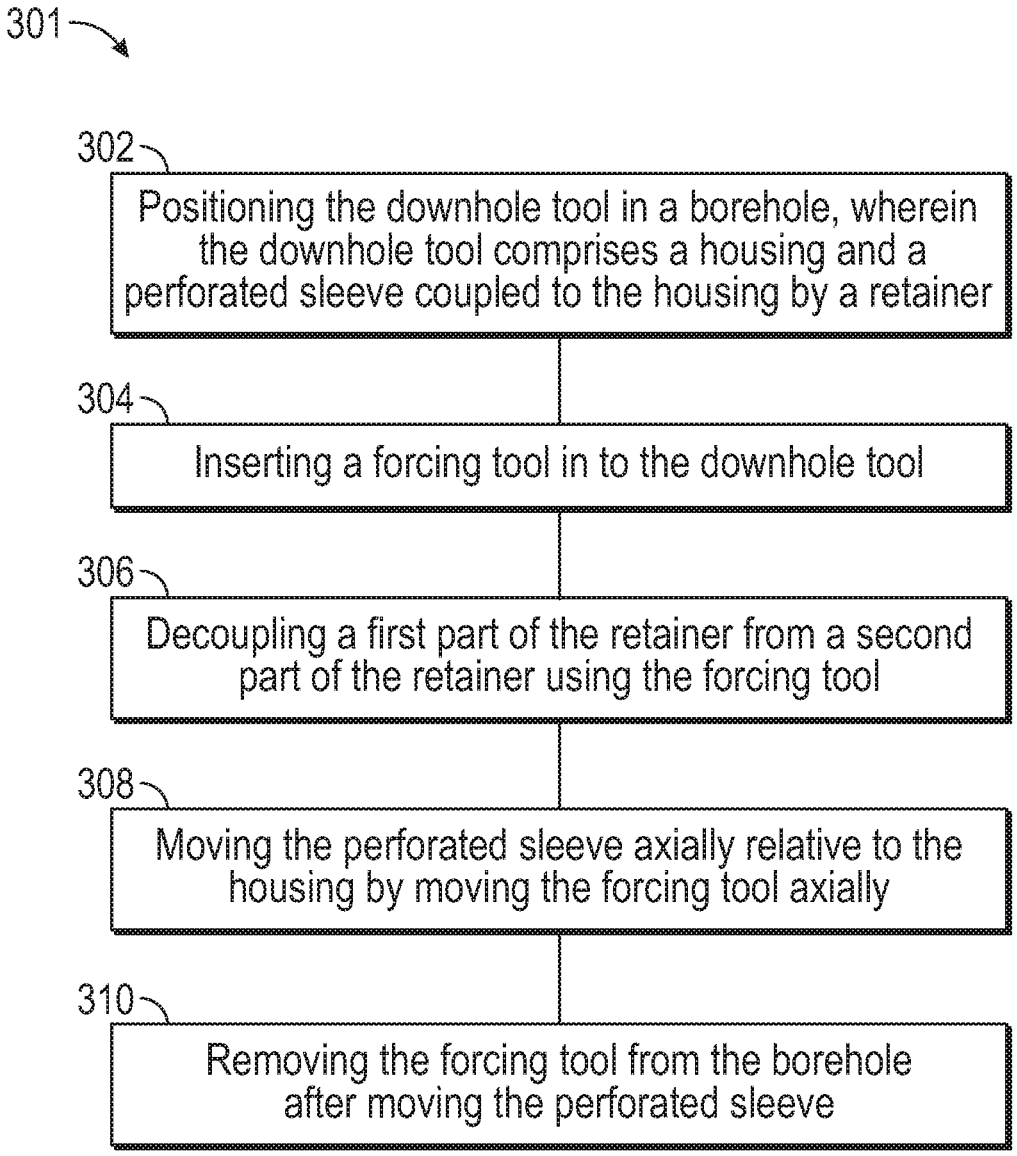
FIG. 11 shows a flow diagram showing a method for operating a downhole tool such as the completion tool of FIG. 1 in accordance with principles disclosed herein.

FIG. 11 shows an exemplary method 301 for actuating a downhole tool in accordance with principles described herein. At block 302, method 301 includes positioning the downhole tool in a borehole, wherein the downhole tool comprises a housing and a perforated sleeve coupled to the housing by a retainer. Block 304 includes inserting a forcing tool into the downhole tool. The forcing tool may be, as examples, rotatable milling tool 270 or a shifting tool, as described above. Block 306 includes decoupling a first part of the retainer from a second part of the retainer using the forcing tool. Block 308 includes moving the perforated sleeve axially relative to the housing by moving the forcing tool axially. Block 310 includes removing the forcing tool from the borehole after moving the perforated sleeve.

In some instances, the operation of block 306 or block 308 includes pushing against the perforated sleeve using the milling tool. In some instances, the operation of block 306 includes cutting a portion of the annular retainer using the milling tool to allow perforated sleeve to slide relative to the housing.

Method 301 may be used, for example, to operate tool 100 on completion string 50. Various embodiments of method 301 may include fewer operations than described, and other embodiments of method 301 include additional operations based on other concepts presented in this specification, including the figures.

Figure 12:
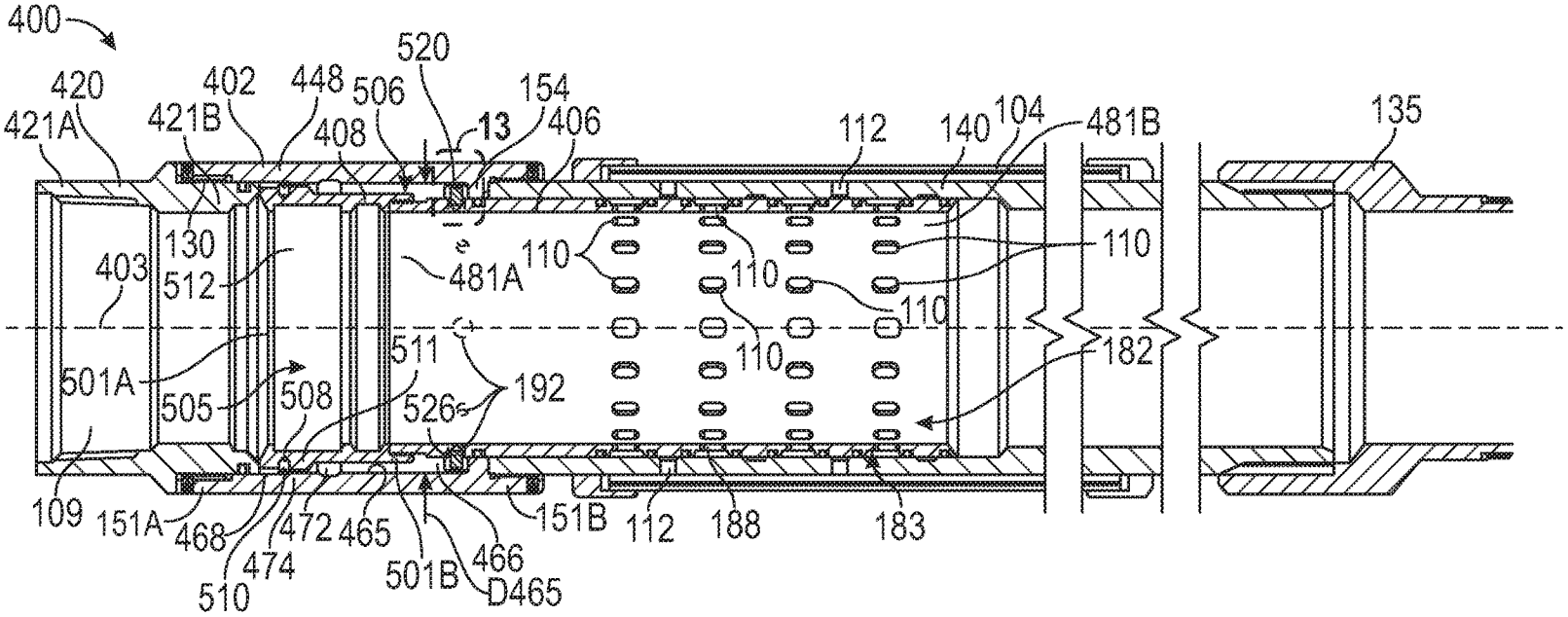
FIG. 12 shows a side view in cross-section of another embodiment of a completion tool for downhole use, in accordance with principles described herein.

FIG. 12 presents another exemplary embodiment of an actuable downhole tool, which in this example is a completion tool 400. As examples, tool 400 may replace tool 100 in various embodiments of string 50 of FIG. 1 or for the various purposes described for tool 100. Like tool 100, tool 400 is screened sleeve assembly and includes a tubular housing 402 extending along an axis 403, a screen 104 surrounding the housing, a movable sleeve 406 disposed within the housing, held by an annular retainer 408. In this example, sleeve 406 is perforated and may also be called perforated sleeve 406. A bore 109 extends through tool 400 along axis 403. During operation, retainer 408 is adjusted with the aid of forcing tool to allow the sleeve 406 to slide within housing 402 so that a plurality of circumferentially and axially-spaced apertures or ports 110 in sleeve 406 may align with a plurality of circumferentially and axially-spaced apertures or ports 112 in housing 402 that are axially aligned with screen 104. When ports 110 are aligned with ports 112, fluid communication is possible between inner bore 109 and the outer surface of tool 400 through screen 104. When tool 400 is installed in a borehole the left direction on axis 403 shown in FIG. 12 is uphole, and the right direction on axis 403 is downhole.

Continuing to reference FIG. 12, housing 402 is similar to housing 102, and includes an upper tubular mandrel 420, a lower tubular mandrel 135, a perforated housing 140 threadingly coupled to mandrel 135 and extending toward mandrel 420, and a tubular adapter 448 threadingly coupled to mandrel 420 and housing 140. Housing 140 is as previously described, including the ports 112. Screen 104 is disposed about and coupled to housing 140, which may also be called a screen housing 140 in this embodiment. Upper and lower tubular mandrels 420, 135 are configured to threadingly couple to opposite portions of completion string 50.

Upper tubular mandrel 420 includes a threaded upper box end 421A, a lower end 421B having flat end surface, and external threads 130 located between ends 421A, 421B to couple to adapter 448. At least in this embodiment, lower end 421B is not castellated.

Tubular adapter 448 is configured similar to adapter housing 150 of tool 110 and may also be called an adapter housing. For example, adapter 448 includes an internally-threaded upper and lower ends 151A, 151B, and an annular, inward protrusion 154 adjacent lower end 151B. Adapter 448 includes an inner surface 465 extending from protrusion 154 to upper end 151A, inner surface has an inner diameter D465 adjacent protrusion 154, forming a recess 466 there. Along inner surface 465, adapter 448 includes a deeper bore or annular recess 468 extending axially inward from threaded end 151A and an annular recess or groove 472 spaced-apart from recess 468 toward protrusion 154, leaving a protrusion or landing 474 between recesses 468, 472. Landing 474 includes inward-facing tapered ends adjoining recesses 468, 472.

Perforated sleeve 406 is a tool member similar to sleeve 106. For example, sleeve 406 extends axially from an inward beveled upper end 481A to an inward beveled lower end 481B and includes an inner surface 182 and an outer surface 183 having an outer diameter suited to engage slidingly the screen housing 140. Axially-space groups of the ports 110 extend radially through surfaces 182, 183. Each group includes a plurality of the ports 110 positioned within one of a plurality of annular recesses 188 on the outer surface 183. Sleeve 406 further includes a plurality of circumferentially-spaced holes 192 located proximal upper end 181A. In the assembly of tool 400, at least initially, holes 192 are axially aligned with inner surface 465 above protrusion 154 in adapter 448.

Figure 13:
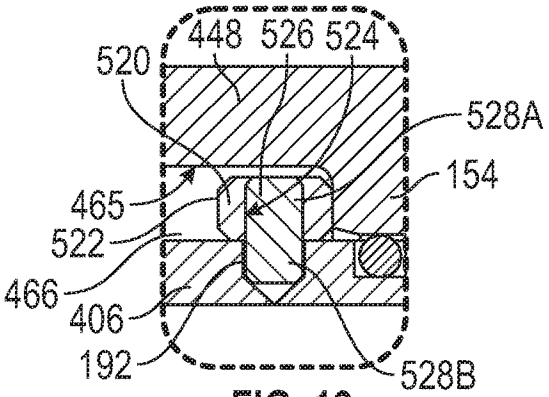
FIG. 13 shows a close view of a portion of the completion tool of FIG. 12.

Referring now to FIG. 12 and the close view of FIG. 13, another annular retainer 520 is shown positioned within recess 466 of adapter 448, surrounding sleeve 406. Retainer 520 includes a ring 522 having a plurality of radially-extending holes 524 and a plurality of shear pins 526, which may be formed as a dowel or a screw, as examples. Each pin 526 extends radially from first end 528A located within a hole 524 in ring 522 to a second end 528B located in a hole 192 in sleeve 406. Pins 526 are disposed to perform as bridge portions holding sleeve 406 fixed relative to ring 522. Ring 522 is located within recess 466 of inner surface 465 and adjacent the upper side of protrusion 154 within adapter 448. Shear pins 526 may be configured as smooth dowels, threaded screws, or bolts, as examples, and may be held in ring 522 or holes 192 by a press fit, by threads, or by another suitable configuration. During operation, the breaking of each shear pin 526 into two portions frees sleeve 406 to move axially downward relative to ring 522 and shoulder 154 while ring 522 remains against shoulder 154. As an example, a shear pin 526 may be configured to break, to fracture when it experiences a shear force of 1000 pounds force. Other shear pins having greater or lesser strength may be used in various embodiments, or a different number of shear pins may be installed to customize the shear force that is to be applied to cause sleeve 406 to move. As described, bridge portions 526 (i.e. shear pins 526) couple the ring 522 to sleeve 406 to restrict sleeve 406 from moving relative to the tubular adapter 448 along axis 403. Retainer 520 is configured such that fracturing of shear pins 526 decouples the pins' end portions 528B from ring 522 and adapter 448, allowing perforated sleeve 406 to move downward (to the right in FIG. 12) relative to the adapter 448, along axis 403.

Continuing to reference FIG. 12, annular retainer 408 extends along an axis 403 from an upper end 501A to a lower end 501B and includes an inner surface 505 and an outer surface 506. Along outer surface 506, retainer 408 includes an annular groove 508, which contains a lock ring 510 having beveled ends, and an annular protrusion 511 alongside groove 508 distal end 501A. The outer diameter of protrusion 511 configure it to engage slidingly the inner surface 465 of adapter 448 from the position shown in FIG. 12, past groove 472, and toward protrusion 154, at least when shear pins 526 are fractured or not present. For this purpose, the outer diameter of protrusion 511 is equal to or slightly less than diameter D465. The ends 501A, 501B of retainer 408 are smaller than the inner diameter D465 of adapter 448, leaving an annular clearance volume at each end of retainer 408. The axial length of protrusion 511 is longer than the axial length of groove 472 of adapter 448 to allow retainer 408 to slide along the inner surface of adapter 448 without being obstructed. Configured to engage slidingly the protrusion 511, adapter 448 may be called a guide sleeve, insuring axial movement of retainer 408 and the coupled sleeve 406, although not restricting the rotation of retainer 408 or sleeve 406 about axis 403 in the embodiment of FIG. 12.

When static, ring 510 on retainer 408 has an inner diameter that is greater than inner diameter of groove 508 but less than outer surface 506. Ring 510 extends radially beyond outer surface 506. During operation, ring 510 may be compressed deeper into groove 508. Along inner surface 505, retainer 408 includes an annular groove or recess 512, also called a shifting profile, to receive a forcing tool, such as the shifting tool previously described, to move retainer 408 axially.

In the assembled tool 400 of FIG. 12, upper end 151A of adapter 448 is threadingly coupled to upper mandrel 420. Lower end 151B of adapter 448 is threadingly coupled to screen housing 140, which butts against the lower shoulder of protrusion 154. Retainer 408 is located within adapter 448 with upper end 501A butted against lower end 421B of upper mandrel 420, restricting upward (leftward in FIG. 12) movement of retainer 408. The lower end 501B of retainer 408 receives and threadingly couples the upper end 481A of sleeve 406, holding sleeve 406 in a fixed axial and rotational position relative to retainer 408. Annular groove 508 with lock ring 510 is axially positioned on the upper side (left end) of landing 474 in adapter 448. Ring 510 is sized to remain in groove 508, and the outward bias of ring 510 causes it extended radially outward so that ring 510 sits against landing 474 to restrict retainer 408 and the coupled sleeve 406 from moving axially downward (to the right in FIG. 12). The axial, downward movement of retainer 408 and sleeve 406 is also restricted by retainer 520 with shear pins 526 extending from ring 522 into holes 192 of sleeve 406. Thus, each shear pin 526 is a bridge portion that couples sleeve 406 to adapter 448 to maintain the axial position of sleeve 406 relative to housing 402. Unlike tool 100 which has guide pins 194 extending between sleeve 106 and elongate slots 164 of guide sleeve 160 (FIG. 2), in tool 400 sleeve 406 and retainer 408 may be free to rotate relative to housing 402 because such rotation is not restricted by a particular feature. Guide pins 194 and slots 164 are absent from this example since tool 400 is designed to be actuated by a tool that pulls or pushes rather than by the cutting action of a rotational milling tool. Retainer 520 holds retainer 408 and the coupled sleeve 406 in a fixed axial position with respect to adapter 448 as long as shear pins 526 are not broken. This fixed axial position is the position shown in FIG. 12. Having a configuration that allows shear pins 526 to be fractured, perforated sleeve 406 is a tool member slidingly coupled to a tubular housing or adapter for operation downhole.

In FIG. 12, tool 400 is closed because ports 110 in sleeve 406 are not aligned with ports 112 in housing 402 and are isolated from ports 112 by sealing members. This is a closed position of sleeve 406 with respect to housing 402 and its screen housing 140. Ports 110 are spaced axially upward from the corresponding ports 112 with which they may align.

Completion tool 400 may be operated to open and to close ports 112 of housing 402, by sliding retainer 408 and perforated sleeve 406 with the aid of a the shifting tool, as previously described, gripping within the annular recess 512 of retainer 408. The shifting tool may be used to push axially downward on retainer 408 causing shear pins 526 to fracture and ring 510 to move radially inward as it is pressed against and slides axially along landing 474. In an example, ring 510 reaches the location of annular groove 472 and re-expands to extend within both groove 508 and groove 472 locking retainer 408 and sleeve 406 in a different position with respect to adapter 448 and all of housing 402. This is an open position of sleeve 406 with respect to housing 402 because ports 110 in sleeve 406 are be aligned with ports 112 in housing 402, like tool 100 in FIG. 10. The open position of sleeve 406 provides fluid communication through the ports 110, 112 and between the inner bore 109 and the outer surface of tool 400, including screen 104 to allow hydrocarbons or another fluid to flow into or out from tool 400.

Likewise, sleeve 406 may be moved from an open position, as described, to a closed position (e.g. FIG. 12) by using a shifting tool within the annular recess 512 of retainer 408. Lock ring 510, having beveled ends, will be pulled out from groove 472, being radially compressed by landing 474, and will be slid upward (leftward) to re-expand and to re-engage the opposite side of landing 474. After reaching the upper side of landing 474, ring 510 will again hold the axial position of retainer 408 and sleeve 406 as shown in FIG. 12. Configured with beveled surfaces, lock ring 510 may be called a detent lock ring, being capable of being removed from groove 472. Tool 400 may be repeatedly open and closed in the manner described repeatedly to accommodate various well operations or conditions. In some embodiments, tool 400 may include a locking ring coupled in a manner that restricts the locking ring from releasing such that tool 400 is prevented from moving from the open position to the closed position.

Tool 400 may also be operated by using another type of forcing tool to push downward or to pull upward against retainer 408 or sleeve 406 to severe the shear pins 526. For example, without rotating, milling tool 270 (FIG. 9) may be employed to push against an inwardly protruding shoulder at upper end 501A or at another location for embodiments having an inwardly protruding shoulder with an inner diameter less than the tool diameter DM. The forcing tool may also be operated by a "bridge plug" or "resettable frac plug" or "packer" that is disposed inside and grips the inner surface 182 of sleeve 406 or the inner surface 505 of the retainer 408, whereby a force or pressure is applied on the plug or packer to manipulate sleeve 406 open or closed. For example, to slide the sleeve 406 downward, a force may be exerted on the plug by weight applied on a tubular string that extends uphole from the plug (similar to "weight-on-bit"), or the pressure of a fluid may be applied to the top side of the plug. Some embodiments of tool 400 may be made without shear pins and ring 522, relying on retainer 408 and ring 510 to hold sleeve 406 in the closed position when initially installed in a wellbore.

Referring again to FIG. 8, in some embodiments, rather than the upper annular portion 204 and retainer member 215 of retainer 108 being coupled by a pair of threads, instead portion 204 is coupled to member 215 by another configuration, such as a weld or a pair of surfaces press-fit together. Some embodiments may include portions 204, 220, 230 of retainer 108 fabricated as a single piece.

Referring again to FIG. 2 for comparison, in some embodiments, retainer 108 is replaced by a retainer that is held to adapter 148 by shear pins. This retainer may be formed from two pieces that separate when the shear pins are severed, or the retainer may be formed as a single piece configured to slide within adapter 148 together with perforated sleeve 106 when the shear pins are severed.

Although sleeve 106 was mounted for inside tubular adapter 148 in FIG. 1, in some embodiments in accordance with principles described herein, a sleeve is instead mounted outside a tubular housing or adapter and configured for sliding movement relative thereto. While movable sleeves 106, 406 were perforated in the examples described above, in other embodiments, a movable sleeve 106, 406 has a solid wall configured to cover perforations that are formed in a perforated housing 140. The movable sleeve 106, 406 with a solid wall may be caused to slide by the configurations and methods described above. In at least some of these embodiments, the perforations 112 in housing 140 are located proximal the upper end of a movable sleeve 106, 406 so that downward movement of the solid, movable sleeve uncovers perforations 112. Although, perforated housing 140 was shown surrounded by a screen 104, some embodiments include a perforated housing 140 without a screen 104 around it.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatuses, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially.

What is claimed is:

1. A downhole tool for attachment to a tubular string and configured to receive a forcing tool, the downhole tool comprising:

a tubular mandrel configured for attachment to the tubular string;

a tubular adapter coupled to the mandrel and extending along an axis therefrom;

a movable sleeve coupled to the tubular adapter and including an outer diameter DT; and a retainer comprising:

an first annular portion coupled to the tubular adapter so as to restrict the first annular portion from moving relative to the tubular adapter in an axial direction;

a second annular portion axially spaced from the first annular portion, wherein the second annular portion is coupled to the movable sleeve so as to restrict the second annular portion from moving relative to the movable sleeve in the axial direction; and a bridge portion extending axially from the first annular portion to the second annular portion, wherein the bridge portion restricts the second annular portion and the movable sleeve from moving relative to the tubular adapter in the axial direction;

wherein the bridge portion has an inner diameter D1 that defines a minimum inner diameter of the downhole tool;

wherein the bridge portion is configured to be milled to decouple the second annular portion from the first annular portion and allow the movable sleeve to move relative to the tubular adapter in the axial direction.

2. The downhole tool of claim 1 wherein the retainer is disposed within the tubular adapter and wherein the retainer further comprises:

an annular void axially positioned between the first annular portion and the second annular portion;

wherein the second annular portion is fixably coupled to the movable sleeve such that downward movement of the second annular portion causes the movable sleeve to move downward;

wherein the bridge portion extends axially from the first annular portion to the second annular portion, wherein the bridge portion comprises a through-passage defining the inner diameter D1 and a thin walled annular segment having an outer diameter D2 that is greater than the inner diameter D1 and less than the outer diameter DT, wherein the thin annular walled segment is adjacent to the annular void.

3. The downhole tool of claim 1 further comprising:

an inward-facing annular recess on an inner surface of the tubular adapter; and a retaining ring disposed radially between the tubular adapter and the movable sleeve;

wherein the movable sleeve includes an outward facing annular recess having a first position axially displaced from the inward-facing annular recess and a second position axially aligned with the inward-facing annular recess; and wherein when the retaining ring is configured such that when the outward facing annular recess is in the second position, the retaining ring is disposed in both the inward-facing annular recess and the outward facing annular recess to restrict the axial movement of the movable sleeve relative to the tubular adapter.

4. The downhole tool of claim 1 wherein the tubular adapter comprises:

an adapter housing; and a guide sleeve disposed within the adapter housing, the guide sleeve comprising a plurality of slots that extend axially;

wherein the movable sleeve is coupled within the guide sleeve;

wherein a plurality of guide pins extend radially from the movable sleeve and into the plurality of slots to allow axial movement of the movable sleeve with respect to the guide sleeve and to restrict the rotational movement of the movable sleeve with respect to the guide sleeve.

5. The downhole tool of claim 2 wherein the mandrel comprises an inner diameter D4, and wherein the outer diameter D2 is less than the inner diameter D4.

6. The downhole tool of claim 1 wherein the movable sleeve is disposed within the tubular adapter, wherein the moveable sleeve extends axially away from the tubular mandrel, and wherein the movable sleeve extends beyond the tubular adapter.

7. The downhole tool of claim 1 further comprising:

a screen housing extending axially from the tubular adapter and having a first plurality of perforations; and a screen surrounding the screen housing;

wherein the movable sleeve is a tubular valve member extending axially from within the tubular adapter to a location within the screen housing, wherein the movable sleeve includes a second plurality of perforations; and wherein the movable sleeve is axially movable with respect to the tubular adapter and the screen housing from a first position with the first plurality of perforations and the second plurality of perforations out of alignment to a second position with the first plurality of perforations and the second plurality of perforations axially aligned.

8. The downhole tool of claim 1 further comprising:

a perforated housing extending axially from the tubular adapter and having a first plurality of perforations;

wherein the movable sleeve is a tubular valve member extending axially from within the tubular adapter to a location within the perforated housing, wherein the movable sleeve includes a second plurality of perforations;

wherein the movable sleeve is axially movable with respect to the tubular adapter and the perforated housing from a first position with the first plurality of perforations and the second plurality of perforations out of alignment to a second position with the first plurality of perforations and the second plurality of perforations axially aligned.

9. A downhole tool for attachment to a tubular string and configured to receive a milling tool that includes a cutting diameter DM, the downhole tool comprising:

a tubular mandrel configured for attachment to the tubular string;

an adapter housing coupled to the mandrel;

a guide sleeve disposed within the adapter housing and extending along a central axis;

a movable sleeve disposed within the guide sleeve and configured for sliding axial movement within the guide sleeve;

a retainer disposed within the guide sleeve at an axial location that is uphole of the movable sleeve, the retainer comprising:

an upper annular portion and a lower annular portion axially spaced from the upper annular portion, wherein the upper annular portion is fixably coupled to the guide sleeve to restrict relative movement of the upper annular portion relative to the guide sleeve, and wherein the lower annular portion is fixably coupled to the movable sleeve;

an annular void between the upper annular portion and the lower annular portion; and a bridge portion extending axially from the upper annular portion to the lower annular portion, wherein the bridge portion restricts the upper annular portion from moving relative to the lower annular portion, wherein the bridge portion includes a through-passage having a diameter D1 that defines a minimum inner diameter of the downhole tool, wherein the bridge portion defines a thin walled annular segment of the retainer having an outer diameter D2 that is greater than D1, wherein the thin walled annular segment is positioned radially adjacent to the annular void, wherein the bridge portion is configured to be milled to allow the lower annular portion and the moveable sleeve to move axially relative to the tubular adapter.

10. The downhole tool of claim 9 further comprising:

a screen housing extending axially from the adapter housing and having a first plurality of perforations; and a screen surrounding the screen housing;

wherein the movable sleeve extends axially beyond the guide sleeve to a location within the screen housing, wherein the movable sleeve includes a second plurality of perforations; and wherein the movable sleeve is axially movable with respect to the guide sleeve and the screen housing from a first position with the first plurality of perforations and the second plurality of perforations out of alignment to a second position with the first plurality of perforations and the second plurality of perforations aligned to allow fluid flow through the first plurality of perforations and the second plurality of perforations.

11. The downhole tool of claim 9 further comprising:

a perforated housing extending axially from the adapter housing and having a first plurality of perforations; and wherein the movable sleeve extends axially beyond the guide sleeve to a location within the perforated housing and includes a second plurality of perforations; and wherein the movable sleeve is axially movable with respect to the guide sleeve and the perforated housing from a first position with the first plurality of perforations and the second plurality of perforations out of alignment to a second position with the first plurality of perforations and the second plurality of perforations aligned to allow fluid flow through the first and second plurality of perforations.

12. The downhole tool of claim 9 wherein the annular void extends radially from a first end adjacent the thin walled annular segment to a second end distal the thin walled annular segment, and wherein an axial width of the annular void is non-uniform.

13. The downhole tool of claim 12 wherein the axial width of the annular void is greater at the first end than at the second end.

14. The downhole tool of claim 9 wherein the bridge portion axially spans the annular void and includes a first end on one side of the annular void that is coupled to the lower annular member and a second end on the opposite side of the annular void that is coupled to the upper annular member.

15. The downhole tool of claim 9 wherein the bridge portion comprises a first material and the upper annular portion comprises a second material, wherein the first material is different than the second material.

16. The downhole tool of claim 9 wherein the lower annular portion of the retainer engages an end of the movable sleeve to move with the movable sleeve.

17. The downhole tool of claim 16 wherein the movable sleeve is perforated.

18. The downhole tool of claim 9 wherein the upper annular portion of the retainer comprises a beveled surface at its uppermost end.

19. The downhole tool of claim 18 wherein the upper annular portion of the retainer comprises a beveled surface adjacent the annular void.

* * * * *